US008191176B2

(12) United States Patent
Oomae

(10) Patent No.: US 8,191,176 B2
(45) **Date of Patent: *Jun. 5, 2012**

(54) LOWER-BODY GARMENT WITH COMBINED STRETCHABLY-RETAINED, FASTENABLY-SLIT WAIST

(75) Inventor: Takako Oomae, Matsue (JP)

(73) Assignee: Minami Honten Corporation, Matsue-shi (JP)

( * ) Notice: Subject to any disclaimer, the term of this patent is extended or adjusted under 35 U.S.C. 154(b) by 36 days.

This patent is subject to a terminal disclaimer.

(21) Appl. No.: 12/839,406

(22) Filed: Jul. 20, 2010

(65) Prior Publication Data

US 2011/0010824 A1 Jan. 20, 2011

Related U.S. Application Data

(63) Continuation of application No. 11/691,500, filed on Mar. 27, 2007, now Pat. No. 7,757,308, which is a continuation-in-part of application No. 11/382,935, filed on May 12, 2006, now abandoned.

(51) Int. Cl.
*A41D 1/06* (2006.01)

(52) U.S. Cl. ..... 2/237; 2/221

(58) Field of Classification Search ..... 2/237, 236, 2/219, 220, 221, 229, 235, 311
See application file for complete search history.

(56) References Cited

U.S. PATENT DOCUMENTS 143,792 A * 10/1873 Taylor ..... 2/237
280,444 A * 7/1883 Bush ..... 2/237
518,369 A * 4/1894 Leavitt ..... 2/237
886,894 A * 5/1908 Fowler et al. ..... 2/237
1,016,538 A * 2/1912 Ashworth ..... 2/400
1,642,483 A * 9/1927 Bloomenthal ..... 2/237
1,692,312 A * 11/1928 Reichel ..... 2/237
1,927,179 A * 9/1933 Levinsohn ..... 2/102
1,948,444 A * 2/1934 Krein ..... 2/237
2,024,922 A * 12/1935 Hendel ..... 2/237
2,063,886 A * 12/1936 Alexandre ..... 2/237
2,197,584 A * 4/1940 Latter ..... 2/237
2,206,505 A * 7/1940 Klein ..... 2/237
2,223,157 A * 11/1940 Berger ..... 2/237
2,411,129 A * 11/1946 Aprile ..... 2/402
2,583,992 A * 1/1952 Bouteloup ..... 2/237
2,854,670 A * 10/1958 Naccash ..... 2/237
3,098,238 A * 7/1963 Diamond ..... 2/237
3,438,061 A * 4/1969 Goldberg ..... 2/237
3,515,143 A * 6/1970 Black ..... 450/109
3,602,916 A * 9/1971 Aach ..... 2/48
3,638,242 A * 2/1972 Herter ..... 2/237
3,793,645 A * 2/1974 Kadison ..... 2/221
3,835,473 A * 9/1974 Toyoda ..... 2/237
4,193,136 A * 3/1980 Pierce ..... 2/237
4,477,928 A * 10/1984 Graff ..... 2/221

(Continued)

*Primary Examiner* — Katherine Moran
*Assistant Examiner* — Richale Quinn
(74) *Attorney, Agent, or Firm* — James Judge

(57) ABSTRACT

Lower-body garment with a combined stretchably-retained, fastenably-split waist. The waistband is sleevelike and split by overlapping ends having circumferentially opposing mouths. A stretchable band is encapsulated in, and unfixed entirely throughout, the waistband. The stretchable band has opposing ends passing out of the opposing mouths in the waistband and coupled into an endless loop by a coupling device for adjusting the length of the stretchable band. An unfastenable locking mechanism is provided on the overlapping ends of the waistband. Opening/closing portions are formed by at least one split in a predetermined location in the garment body, extending to a common terminal position and continuous with the split in the waistband.

9 Claims, 7 Drawing Sheets

U.S. PATENT DOCUMENTS

| | | | | | |
|---|---|---|---|---|---|
| 4,480,339 | A | * | 11/1984 | Hubbard, Sr. | 2/237 |
| 4,596,055 | A | * | 6/1986 | Aach et al. | 2/237 |
| 5,144,697 | A | * | 9/1992 | Sandbeck | 2/236 |
| 5,544,366 | A | * | 8/1996 | Kato | 2/237 |
| 6,081,930 | A | * | 7/2000 | Phillips | 2/237 |
| 6,385,777 | B1 | * | 5/2002 | Hamada et al. | 2/221 |
| 6,526,597 | B1 | * | 3/2003 | Shepard | 2/255 |
| 6,880,175 | B2 | * | 4/2005 | Tajima et al. | 2/237 |
| 7,757,308 | B2 | * | 7/2010 | Oomae | 2/237 |

* cited by examiner

FIG. 3
PRIOR ART
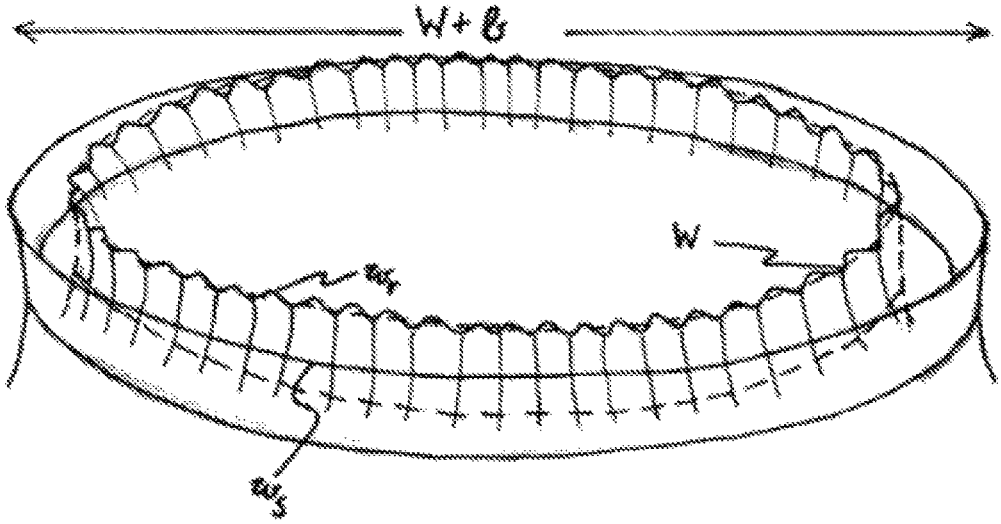
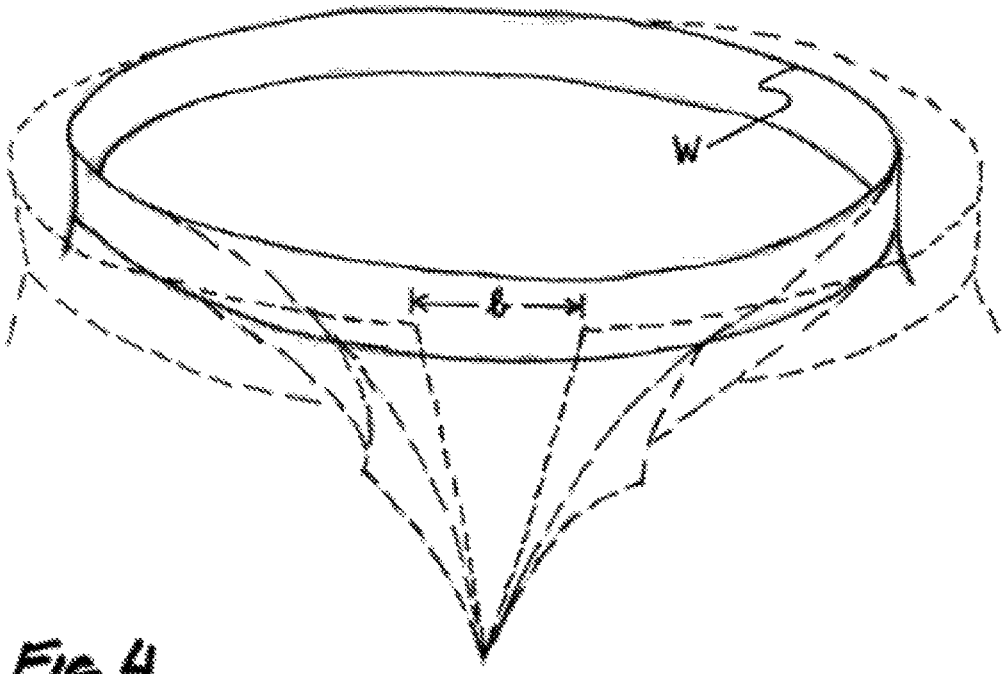
FIG. 4

LOWER-BODY GARMENT WITH COMBINED STRETCHABLY-RETAINED, FASTENABLY-SLIT WAIST

BACKGROUND OF THE INVENTION

1. Technical Field

The invention described in the present specification relates to lower-body garments, such as skirts, trousers and shorts, with an adjustable waist portion, and in particular relates to facilitated waist-portion adjustability that does not compromise the appearance of the garments.

2. Description of the Related Art

Getting into a lower-body garment such as a pair of slacks or a skirt involves the usual human anatomical fact that a person's waist is smaller than their buttocks. Apart from lower-body garments made entirely of a stretchable fabric, as for example with hoses and tights, lower-body garments will have a waist portion that is either the same size as the girth around the buttocks where they are most protuberant, or that is narrower so as to snugly match the wearer's waist. In the former instance—as with pajama and other casual pants and shorts as well as sweat pants and shorts—the waist portion must be drawn into gathers as it is cinched, usually with a cord or elastic or even with a combination of the two, about the wearer's waist. In the latter instance, as with dress skirts, shorts and slacks, the waist is split deeply enough to allow the waist ends to be pulled apart so as to create a breach in the form of triangle whose base is at least as long as the difference in girth between the wearer's buttocks and waist. In this latter, most common configuration, the split is closed by any of a variety of fastening means to fit the garment waist portion snugly about the wearer.

It can often enough happen that a wearer's waistline changes, with expanding be more common than shrinking. With lower-body garments having a waist portion of the same size as the girth around the buttocks, unless the waist has grown larger than that girth, the clothing will still fit. With dressier lower-body garments having the fastenably split waist, however, a wearer with a changed waistline, for reasons of economy, convenience, or simply because the wearer likes a particular garment that is no longer replaceable, may still want to use a particular lower-body garment. Yet if such a wearer's waistline has expanded, he or she is faced with having costly alterations done or attempting the laborious, involved task of doing the alteration him or herself.

Of course, there are any number of lower-body garments on the market that have so-called comfort waists with give-and-take sections, usually along the hips, where elastic has been either sewn into a lengthened portion of the waistband and bunches the lengthened portion into gathers, or has been anchored into portions of the waistband in such a way as to tend to draw the portions together. In the latter case, very often the waistband is split, together with part of the garment—usually along the pockets, where the split is thus concealed—forming overlapping waistband sections retained that way by the anchored elastic between the sections.

An example of this latter contrivance is explained in considerable detail in U.S. Pat. No. 4,193,136 to Pierce. Pierce teaches an elastic closure system for a split waistband. The Pierce system is designed to elastically tension the waistband across dual lateral splits by oppositely acting elastic urging means. In the exemplary Pierce embodiment, the rear panel of trousers is urged forwardly at the splits by inside elastic bands, while the front panel of the trousers is urged rearwardly at the splits by outside elastic bands.

The outside and inside elastic bands exit respective tunnel openings that open in the same direction along the waistband, but the inside elastic bands upon exiting their tunnel openings are bent in a "U" and anchored onto a section of the waistband where the outside elastic bands are also anchored.

The elastic closure system according to Pierce, thus structured with a straight elastic band and a U-shaped elastic band, anchored to respective front and back trouser panels and to either side of a split in the trouser waistband, functions to draw the front and back panels toward each other, inasmuch as the inside and outside elastic bands act in opposite directions. The Pierce elastic closure system thus closes the dual lateral waistband splits in a manner that automatically adjusts to the wearer's waist.

Other such comfort-waist systems in lower-body garments on the market may be more or less complex, but all rely on a similar basic configuration in which elastic is anchored into portions of the waistband so as to allow the waistband to be expanded in those portions while retaining the waistband snug about the wearer. With the elastic bands in such systems being anchored by firm stitching of either ends into the waistband, however, the systems are not adjustable beyond what give-and-take the elastic provides. Moreover, although the elastic tends to wear out easily as a consequence of the anchoring it is prohibitively difficult to replace.

U.S. Pat. No. 6,081,930 to Phillips, meanwhile, teaches a similar system, except that the split is the fly of a pair of trousers, and the elastic is a band encircling the entire waist, but split with ends in the overlapping portions of the fly. One end of the elastic band is anchored to the overlying waistband-end of the fly, and the other end of the band is adjustably fixed to the underlying waistband-end of the fly.

In the Phillips configuration, however, the adjustable end of the elastic band passes under the overlapping fly and along the outside of the waistband, where it must be dealt with by the wearer. Moreover, although the elastic band is adjustable, the adjusting must be done unilaterally, which not only is an awkward operation, but would tend to set up uneven tension distribution in the band around the waist.

BRIEF SUMMARY OF THE INVENTION

An object of the present invention is to configure the waistband and associated portion of a lower-body garment so that the waistband itself stretchably accommodates changes in the wearer's waist size without bunching the waistband into unsightly gathers.

A further object of the invention is to enable a user both to easily adjust and to easily replace the stretchable band within the waistband portion of a lower-body garment.

The invention in one aspect is a lower-body garment with a combined stretchably-retained, fastenably-split waist. The waistband along the upper end of the garment body is sleeve-like and split by overlapping ends having circumferentially opposing mouths. A stretchable band is encapsulated in, and unfixed entirely throughout, the waistband such as to be stretchably expandable and contractible circumferentially along the waist. The stretchable band has opposing ends passing out of the opposing mouths in the waistband and coupled into an endless loop by coupling means for adjusting the length of the stretchable band. An unfastenable locking means is provided on the overlapping ends of the waistband, for locking the overlapping ends together to cover and hide the stretchable band from being exposed from the ends of the waistband. Opening/closing portions are formed by at least one split in a predetermined location in the garment body, extending to a common terminal position and continuous with the split in the waistband. An opening/closing means closably separates the opening/closing portions away from each other.

The mouth in one end of the waistband may open along the waistband latterly, at about the distance from the tip of the one end by which the one end overlaps the other end.

Opening/closing means may be furnished extending across the split in the waistband, from the upper to the lower edges of the opposing ends thereof, and to the common terminal position of opening/closing portions formed by the spilt in the garment body, whereby the opening/closing portions continuous with the opposing ends of the waistband part are separable leftward and rightward from each other by the opening/closing means.

In lieu of the stretchable band, a belt interlining may be encapsulated in the waistband and in at least one predetermined location split in opposing belt-interlining ends separated to accommodate a waist-size adjustment as the coupling means, in which case the waist size adjustment is composed of a flexible mesh fixed to the opposing ends of the belt interlining, and a cord is laced through the mesh and tied in a loop to draw the opposing ends of the belt interlining adjustably together.

In a lower-body garment of the present invention, the waistband is elasticized or otherwise stretchable, yet does not bunch the waistband into gathers.

The stretchable band in the waist portion of a lower-body garment of the present invention is unfixed entirely along the waistband, for a simpler configuration from a clothing design perspective in that no complex stretch-band anchoring mechanisms about overlapping splits in the garment are required. This can make for a longer-lasting waistband configuration.

What is more, the adjustment means in the stretchable band in the waist of a lower-body garment of the present invention can be on-band and accessible in the split opening. Adjusting the stretchable band does not involve the waistband fabric.

And the stretchable band can be replaced simply by undoing the coupling means and replacing the band in its entirety, without having to disturb the waistband itself.

While the following is a more detailed description, in conjunction with the accompanying drawings, of the present invention, objects, features, aspects and advantages not herein explained have already been set forth in the parent of the present application, U.S. patent application Ser. No. 11/691,500, identified in the application data sheet (ADS) for the instant application, and issuing as U.S. Pat. No. 7,757,308. The non-redundant portions of application Ser. No. 11/691,500 are herein incorporated by this reference thereto.

BRIEF DESCRIPTION OF THE SEVERAL VIEWS OF THE DRAWINGS

FIG. 3 is a perspective view corresponding to FIG. 1, but emphasizing dimensional details;

FIG. 4 is a perspective view corresponding to FIG. 2, but emphasizing dimensional and operational details;

FIG. 5 are views of a skirt in a fundamental embodiment of the present invention, wherein

DETAILED DESCRIPTION OF THE INVENTION

Figure 1:
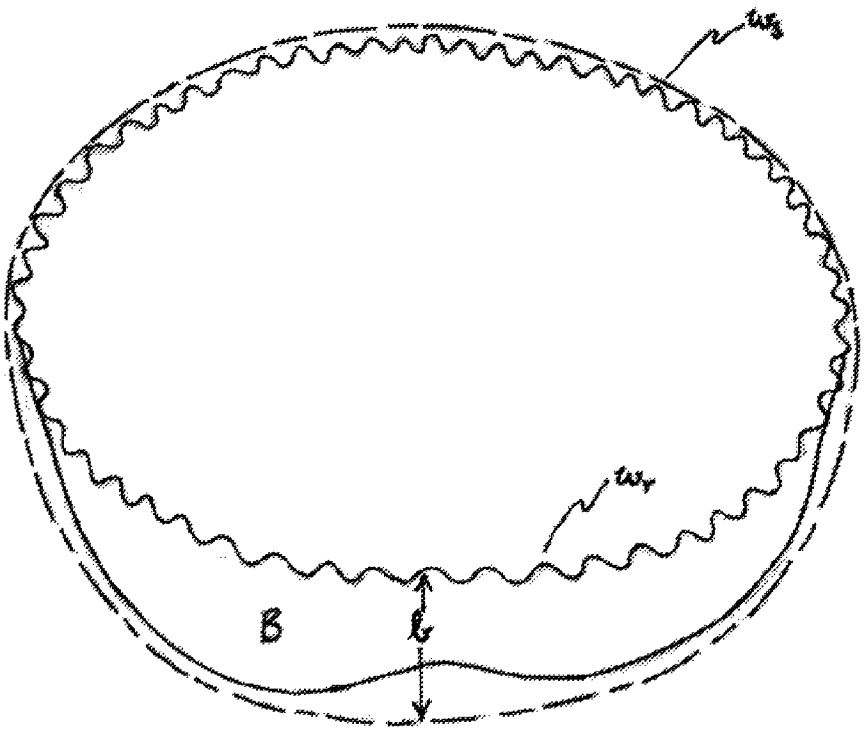
FIG. 1 PRIOR ART
FIG. 1 is an abstract, sectional view through the waistline of wearer of a conventional lower-body garment, with the outline of the garment's elasticized waistband at rest on the wearer's waist shown as a solid, undulating line, and the outline of the waistband stretched over the wearer's buttocks shown in phantom.
Figure 2:
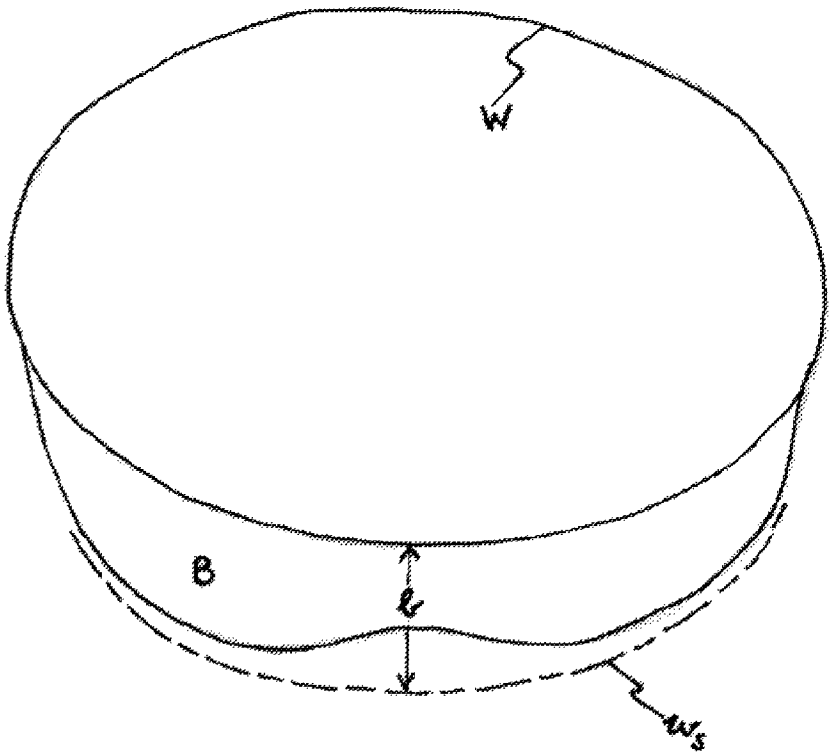
FIG. 2 is a view similar to FIG. 1, but indicates how an elasticized waistband of the present invention eliminates the extra length b that the conventional elasticized waistband of FIG. 1 requires.

In general a person's waist W is smaller than their buttocks B by an amount b, as indicated in FIGS. 1 and 2. Consequently, any waist-worn garment without a closable split must have a waistband larger than the wearer's waist W by the length b; the waistband must be at least W+b in circumference. If the lower-body garment is retained about a wearer's waist with an unbroken waistband encapsulating an elastic band, the elastic band must be able to stretch to $w_s \geqq W+b$, and shrink back to $w_r \approx W$, its circumference at rest, in which state the elasticity of the band retains the garment snugly about the wearer's waist by bunching the waistband length b into gathers as indicated in FIG. 1. In a perspective view, FIG. 3 illustrates these realities of a conventional waist-worn garment without a closable split.

In a waist-worn garment with a closable split, the circumference of the waistband closely fits the wearer's waist W. Rather than stretch to the circumference $w_s \approx W+b$, as indicated in FIG. 2, the length b is accommodated by the split, which when opened forms a triangular breach whose base is at least equal to the length b. This result of the function of the split is illustrated in FIG. 4, where the dotted lines indicate how in an abstract sense the split opens the garment waist to the size W+b, and the phantom lines indicate how the split is actually peeled outward when the garment is put on or taken off.

The present invention combines the advantages of a waistband encapsulating a full-circumference stretchable band and of a garment waist with a closable split. Hence, the size of a waistband in a lower-body garment according to the present invention can be ≈W, eliminating the bunching length b. And while the stretchable band encapsulated in the waistband must stretch to $w_s$, since the configuration of the present invention eliminates gathers, a lesser load is placed on the stretchable band at rest.

Put conversely, with the conventional lower-body garment waist configuration in which an unbroken waistband encapsulates an elastic band, the elastic must be stronger, so as to retain at rest $w_r$ the undulation of the gathers, than a stretchable band in a lower-body garment waist configuration of the present invention. The elastic band in the conventional configuration is consequently likely to wear out sooner. (It will be appreciated that the undulations indicated at $w_r$ in FIGS. 1 and 3 appear exaggerated, for ease of illustration.)

In sum, the present invention eliminates the gathers that are a consequence of the minimum length b that the elastic band must draw together when at rest around a wearer's waist in conventional lower-body garments with an elastic band but no split, while at the same time evenly distributing tension in an elasticized waistband that is split.

In reality, the conventional unbroken waistband encapsulating an elastic band is b+α larger than the wearer's waist size W, and that "+α" only adds to the amount of material bunching into gathers around the wearer's waist. In a lower-body garment as given by the present invention, the split waistband encapsulating an unfixed, endless stretchable band can allow for a "+α" in the waist by taking the extra length up in the split, without incurring the earlier-discussed disadvantages of conventional comfort-waist configurations. What is more, as will be appreciated from an understanding of the present description, a waistband according to the present invention may be split in more than one location.

Figure 5B:
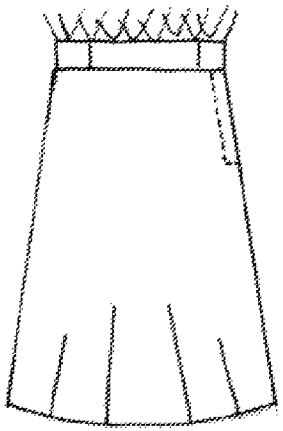
FIG. 5B is a pull-back view of the skirt as worn.
Figure 5A:
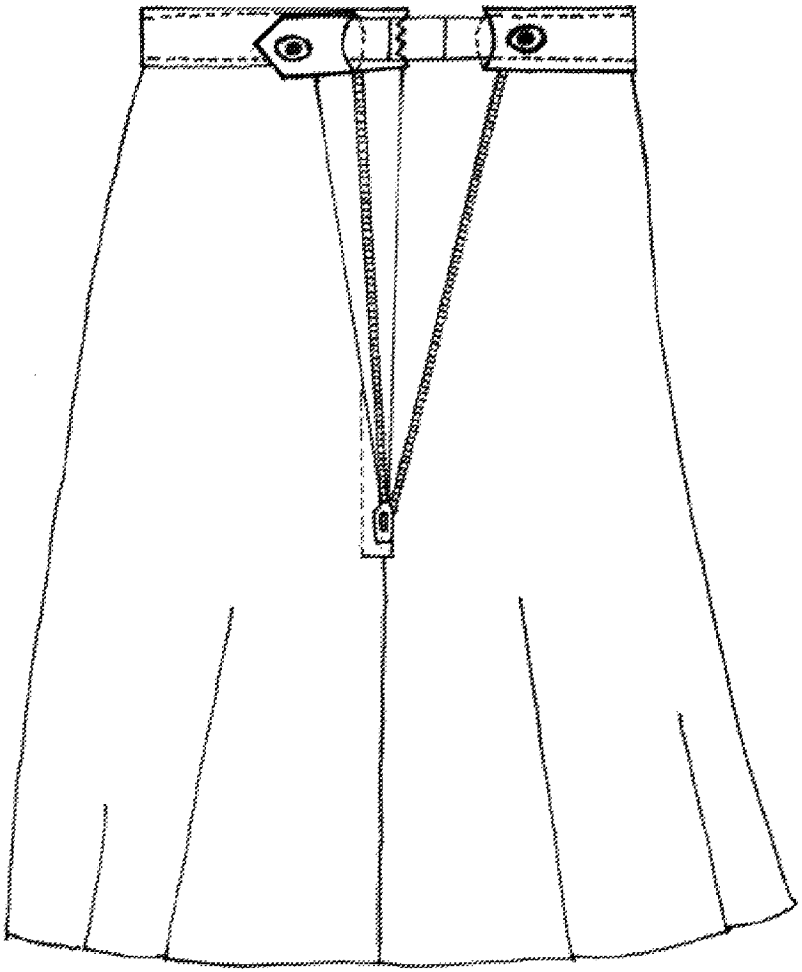
FIG. 5A is a left-side view of the skirt showing details of the stretchably-retained, fastenably-split waist according to the invention.
Figure 6:
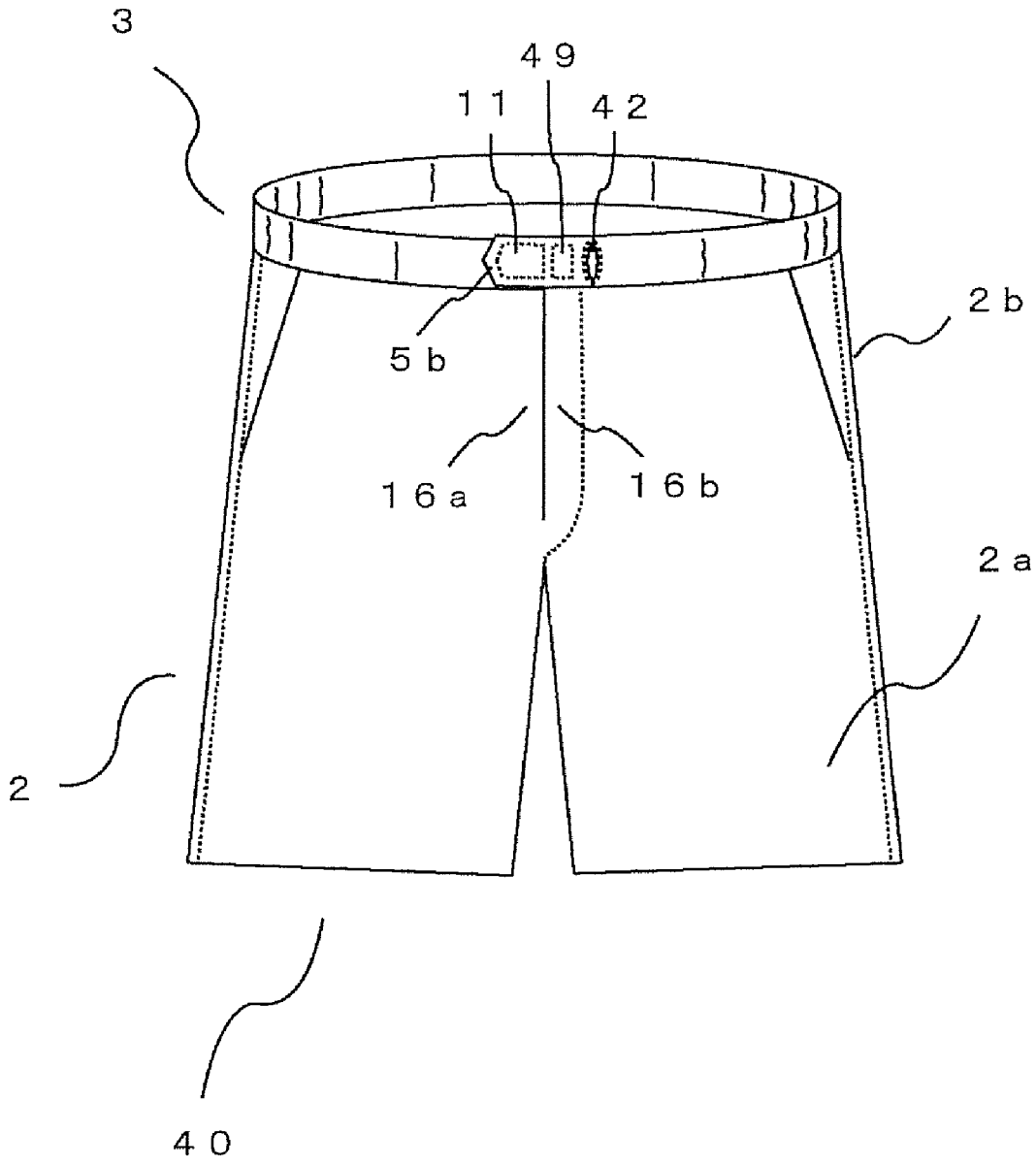
FIG. 6 is a front view of a pair of short trousers according to a embodiment in which in particular the unfastenable locking means on the overlapping ends of the waistband is designed for those with impaired finger movement.
Figure 7:
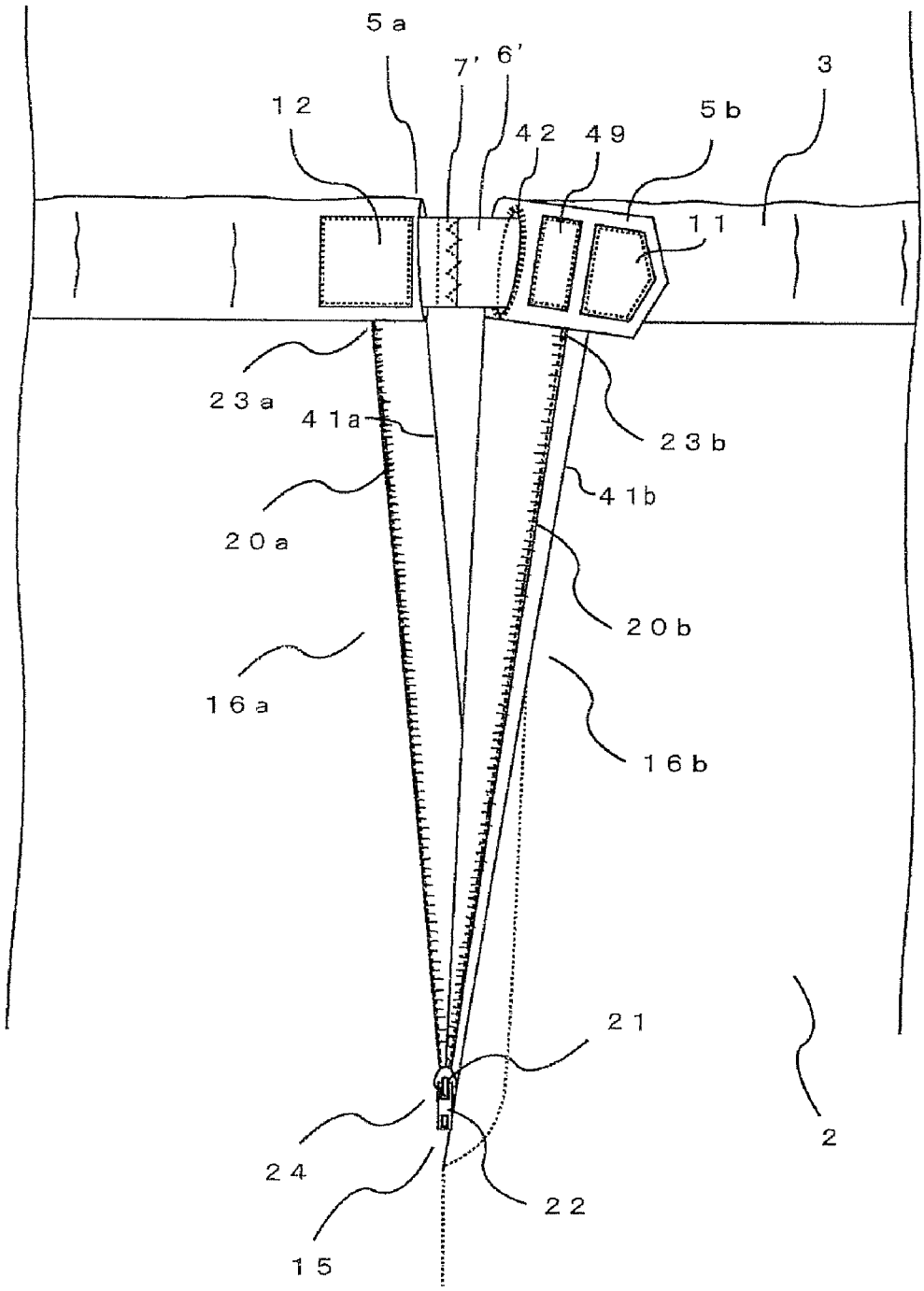
FIG. 7 is a partially enlarged front view of an embodiment in which a slide fastener as the opening/closing means has been slid open, and in which the unfastenable locking means is like that of the embodiment illustrated in FIG. 6.
Figure 8:
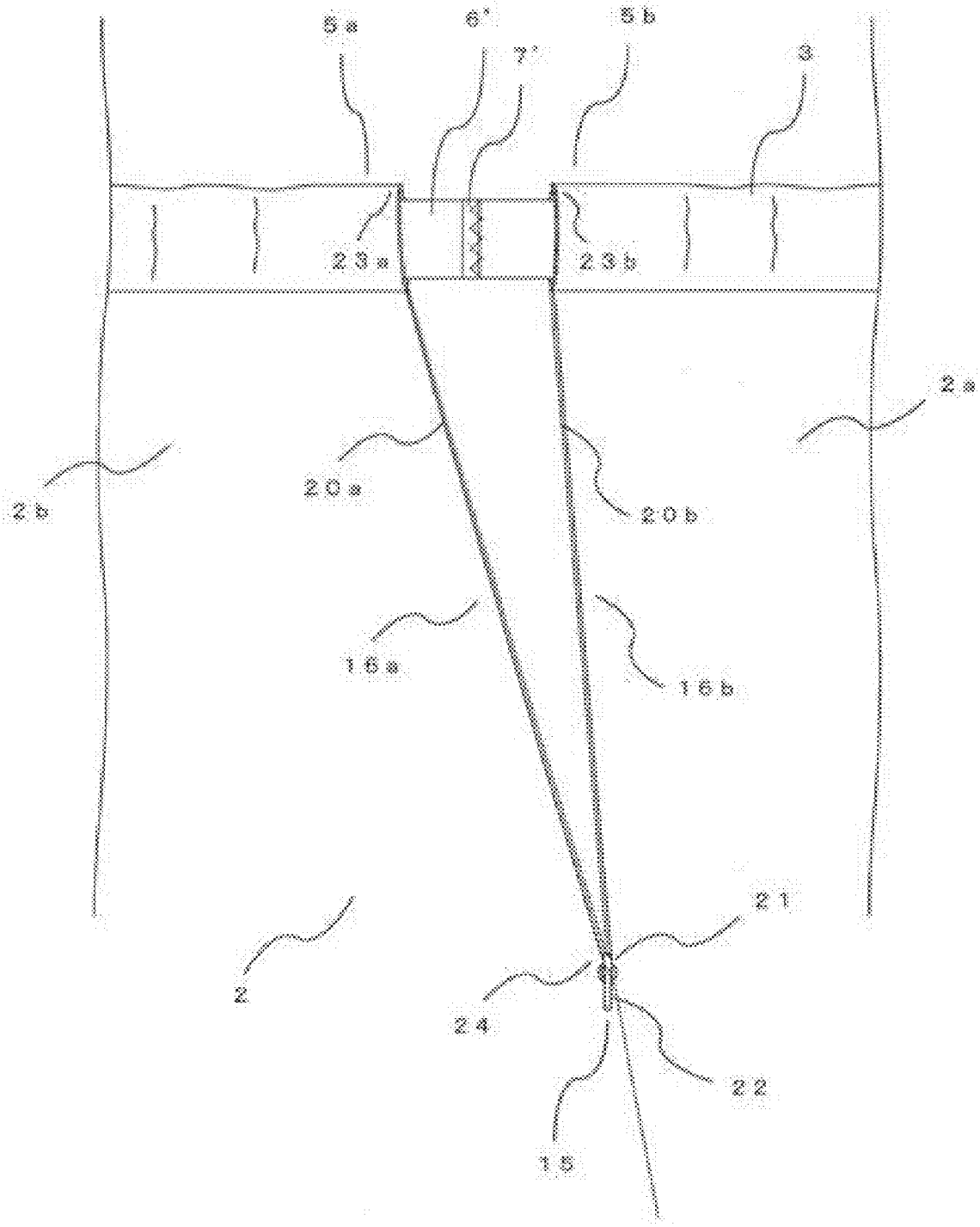
FIG. 8 is a partially enlarged view from the inside of a skirt in which a slide fastener along the split in the skirt is an opening/closing means furnished extending across the split in the waistband as well.
Figure 9:
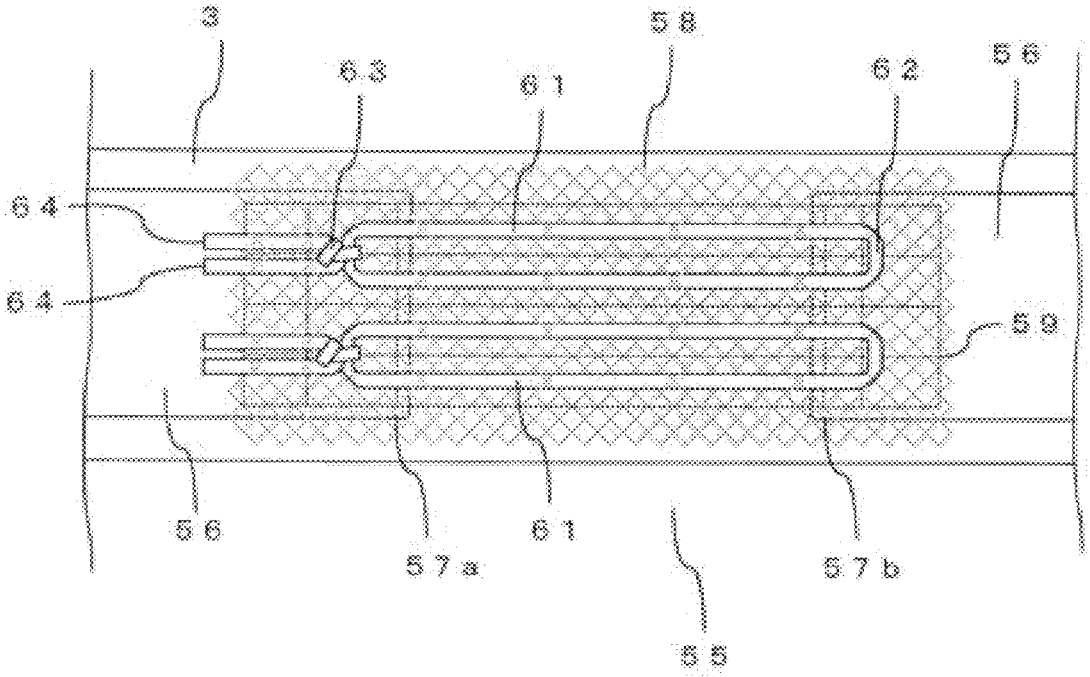
FIG. 9 is a diagram illustrating a waist-size adjustment as the coupling means in embodiments where the stretchable band is a belt interlining, the diagram showing that the adjustment is composed of a meshwork row formed on each of the opposing ends of the stretchable band, and a cord removably interlaced through the opposing meshwork rows.

FIG. 5 is applicant's one preferred embodiment, wherein details of fastening are evident from the drawings.

Details of the stretchable-band coupling means, the waistband-end locking means, and the split opening/closing means are evident from the remainder of accompanying drawings, FIGS. 6 through 9, which are exemplary of course and not limiting of the possible configurations. And inasmuch as configurations and operations of the coupling means, locking means, and opening/closing means are fully described in U.S. patent application Ser. No. 11/691,500, herein incorporated by reference, FIGS. 6 through 9 in particular will not be elaborated upon here.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A lower-body garment with a combined stretchably-retained, fastenably-split waist, the garment comprising:

a body;

a sleevelike waistband provided circumferentially along an upper end of the body, and split by overlapping ends having circumferentially opposing mouths, wherein the mouth in one end opens along the waistband latterly, at about the distance from the tip of the one end by which the one end overlaps the other end;

a stretchable band encapsulated in, and unfixed entirely throughout, the waistband such as to be stretchably expandable and contractible circumferentially along the waist, the stretchable band having opposing ends passing out of the opposing mouths in the waistband and coupled into an endless loop by coupling means for adjusting the length of the stretchable band;

an unfastenable locking means provided on the overlapping ends of the waistband, for locking the overlapping ends together to cover and hide the stretchable band from being exposed from the ends of the waistband;

opening/closing portions formed by at least one split in the body, extending to a common terminal position and continuous with the split in the waistband; and an opening/closing means for closably separating the opening/closing portions away from each other.

2. A lower-body garment as set forth in claim 1, wherein:

said one overlapping end is creased so as to be foldable back on itself; and the locking means includes unfastenable means to hold said overlapping end fast when folded back on itself.

3. A lower-body garment as set forth in claim 1, wherein the coupling means is composed of a meshwork row formed on each of the opposing ends of the elastic band, and a cord removably interlaced through the opposing meshwork rows.

4. A lower-body garment as set forth in claim 2 wherein the coupling means is composed of a meshwork row formed on each of the opposing ends of the elastic band, and a cord removably interlaced through the opposing meshwork rows.

5. A lower-body garment as set forth in claim 1, wherein a belt interlining is included on the elastic band encapsulated in the sleevelike waistband.

6. A lower-body garment with a combined stretchably-retained, fastenably-split waist, the garment comprising:

a body;

a sleevelike waistband provided circumferentially along an upper end of the body, and split by ends having circumferentially opposing mouths; and a stretchable band encapsulated in, and unfixed entirely throughout, the waistband such as to be stretchably expandable and contractible circumferentially along the waist, the stretchable band having opposing ends passing out of the opposing mouths in the waistband and coupled into an endless loop by coupling means for adjusting the length of the stretchable band;

opening/closing portions formed by at least one split in the body, extending to a common terminal position and continuous with the split in the waistband; and opening/closing means extending across the split in the waistband, from the upper to the lower edges of the opposing ends thereof, and to the common terminal position, whereby the opening/closing portions continuous with the opposing ends of the waistband part are separable leftward and rightward from each other by the opening/closing means.

7. A lower-body garment as set forth in claim 6, wherein the coupling means is composed of a meshwork row formed on each of the opposing ends of the elastic band, and a cord removably interlaced through the opposing meshwork rows.

8. A lower-body garment as set forth in claim 6, wherein a belt interlining is included on the elastic band encapsulated in the sleevelike waistband.

9. A lower-body garment with a combined stretchably-retained, fastenably-split waist, the garment comprising:

a waistband provided circumferentially along an upper end of the body;

a unfixed belt interlining encapsulated in the waistband and in at least one predetermined location split in opposing belt-interlining ends separated to accommodate a waist-size adjustment; and a waist size adjustment composed of a flexible mesh fixed to the opposing ends of the belt interlining and thereby coupling it into an endless loop, and a cord laced through the mesh and tied in a loop to draw the opposing ends of the belt interlining adjustably together.

* * * * *